US006305927B1

(12) United States Patent
Keller

(10) Patent No.: US 6,305,927 B1
(45) Date of Patent: Oct. 23, 2001

(54) BURNER WITH ACOUSTICALLY DAMPED FUEL SUPPLY SYSTEM

(75) Inventor: Jakob J. Keller, deceased, late of Wohlen (CH), by Maria Keller-Schärli, Vera Keller, Georg Keller, legal representatives.

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/458,095

(22) Filed: Dec. 10, 1999

(30) Foreign Application Priority Data

Dec. 15, 1998 (EP) ..... 98811230

(51) Int. Cl.[7] ..... F23M 13/00
(52) U.S. Cl. ..... 431/114; 431/350; 60/725
(58) Field of Search ..... 431/350, 114, 431/353, 346; 60/725; 181/249, 229, 214, 213, 255

(56) References Cited

U.S. PATENT DOCUMENTS

| | | | | |
|---|---|---|---|---|
| 804,002 | * | 11/1905 | Fouche | 431/346 |
| 1,702,731 | * | 2/1929 | Hymer | 431/350 |
| 2,765,004 | * | 10/1956 | Hatte . | |
| 2,943,641 | * | 7/1960 | Arnold . | |
| 3,807,527 | * | 4/1974 | Bergson et al. . | |
| 4,464,314 | * | 8/1984 | Surovikin et al. . | |
| 4,760,695 | * | 8/1988 | Brown et al. | 60/725 |
| 5,349,813 | * | 9/1994 | Eisinger . | |
| 5,494,438 | * | 2/1996 | Yang | 431/350 |
| 5,635,687 | * | 6/1997 | Biscaldi . | |
| 5,784,889 | * | 7/1998 | Joos et al. | 431/114 |
| 6,050,078 | * | 4/2000 | Paschereit et al. | 60/725 |
| 6,058,709 | * | 5/2000 | Richards et al. | 431/114 |

FOREIGN PATENT DOCUMENTS

| | | | | |
|---|---|---|---|---|
| 0 321 809 | | 5/1991 | (EP) . | |
| 0726387 | * | 8/1996 | (EP) | 431/114 |
| 0108512 | * | 7/1982 | (JP) | 431/350 |
| 93/10401 | | 5/1993 | (WO) . | |

OTHER PUBLICATIONS

Frutschi, H., "Advanced Cycle System With New GT24 and GT26 Gas Turbines—Historical Background", ABB Review, Jan. 1994, pp. 20–25.

Neuhoff, H., et al., "GT24 and GT26 Gas Turbines—Sequential Combustion the Key to High Efficiencies", ABB Review, Feb. 1994, pp. 4–7.

* cited by examiner

*Primary Examiner*—Carl D. Price
(74) *Attorney, Agent, or Firm*—Burns, Doane, Swecker & Mathis, L.L.P.

(57) ABSTRACT

In a burner (14) with at least one fuel supply system (15, 16) through which the burner (14) is fed a fuel flow (12), and the fuel fed is injected via fuel nozzles and subsequently burned in a combustion chamber (11), the formation and amplification of pressure fluctuations in the combustion chamber is prevented in a simple way in terms of design by virtue of the fact that means (17) are provided which prevent periodic pressure fluctuations which occur in the combustion chamber from leading to fluctuations in the fuel flow (12) in the fuel supply system (15, 16).

11 Claims, 9 Drawing Sheets

BURNER WITH ACOUSTICALLY DAMPED FUEL SUPPLY SYSTEM

BACKGROUND OF THE INVENTION

1. Field of the Invention

The present invention relates to the field of burners, in particular burners for use in gas turbines. It relates to a burner with fuel supply system, in which the fuel supply system transports fuel to the burner, and the fuel in the burner is injected into a combustion chamber where the fuel is burned.

2. Discussion of Background

Burners of gas turbines serve the purpose of injecting the fuel and the combustion air in a way which is controlled and can be regulated into a combustion chamber, and of burning the fuel there, For this purpose, the burners can be recessed in a most varied arrangement in the wall of the combustion chamber, and are charged with fuel by means of a fuel supply system. In order to ensure optimum control of the combustion process in the various operating states of the turbine, the injection of the fuel in the burner must be performed controllably and as optimally as possible. Precisely the regulations to be observed ever more strictly in recent time and relating to the emission from combustion processes are now rendering mandatory a highly specialized and complicated injection and mixing of combustion air and fuel in the burner.

For example, EP-B1-0 321 809 -has disclosed a so-called double-cone burner for liquid and gaseous fuels without a pre-mixing section, in which combustion air fed from outside enters tangentially, through at least two entrance slots, between hollow half cones arranged in a displaced fashion, and flows there in the direction of the combustion chamber, and in which, on the tapered side, averted from the combustion chamber, of the half cones, fuel is injected centrally, or from distribution channels, which run along the air entry slots, through rows of bores transversely into the air which is entering.

A problem with the injection of the fuel and its subsequent combustion are, inter alia, acoustic oscillations, which are also known under the term of "singing flame". These are mostly oscillations which come about from the interplay between the inflow of the combustion mixture and the actual combustion process in the combustion chamber. These largely coherently periodic pressure fluctuations can lead in the case, for example, of a burner of the above-named type under typical operating conditions to acoustic fluctuations with frequencies of approximately 80 to 100 Hz. Since these frequencies can coincide with typical fundamental natural modes of combustion chambers of gas turbines, these thermo-acoustic oscillations constitute a problem.

SUMMARY OF THE INVENTION

Accordingly, one object of the invention is to provide a novel burner with at least one fuel supply system through which the burner is fed a fuel flow, the fuel fed is injected via fuel nozzles and subsequently burned in a combustion chamber, and is capable of preventing at least partially the formation and amplification of periodic pressure fluctuations in the combustion chamber.

This object is achieved in the case of a burner of the type mentioned at the beginning by supplying means which prevent periodic pressure fluctuations which occur in the combustion chamber from leading to fluctuations in the fuel flow in the fuel supply system. The substantial prevention of the coupling of the periodic pressure fluctuations to fluctuations in the fuel flow can prevent the undesired, escalating amplification of the pressure fluctuations by the fuel flow in the combustion chamber. In particular, such means are of great advantage when the periodic pressure fluctuations occurring in the combustion chamber are acoustic oscillations and, quite particularly, when these are situated in the range of the acoustic natural oscillations of the combustion chamber. If the oscillations in the fuel flow in the fuel supply system are periodic, and if, in particular, the frequency of these periodic fluctuations in the fuel flow is situated in the range of the acoustic natural oscillations in the combustion chamber, this escalating effect can be exceptionally pronounced, and prevention of the same can be particularly indicated.

A first preferred embodiment of the invention is typified in that the means comprise at least a first volume arranged directly upstream of the fuel nozzles, through which volume the fuel flow flows, and this first volume is connected upstream via a first constriction to the fuel supply system, which is arranged further upstream. It is preferred in this case for this first volume to be selected essentially smaller than a specific critical volume and, furthermore, in particular for the cross-sectional area of the first constriction to be constructed smaller than a specific critical cross-sectional area. Each of these measures reduces the extent of the coupling of the pressure fluctuations to the fluctuations in the fuel flow and, moreover, the measures can be built into, or even retrofitted in conventional burners without a large design outlay.

Another embodiment of the invention is typified in that arranged upstream of the first constriction is a second volume, through which the fuel flow flows, and this second volume is connected upstream via a second constriction to the fuel supply system, which is arranged further upstream. This arrangement permits the effective prevention of coupling under specific, essentially unchanging design stipulations of the burner and of the fuel supply system.

Further embodiments of the burner with fuel supply system follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

It emerges, in particular upon switching over between different operating modes of a gas turbine such as, for example, upon switching over between premixing and pilot modes, that the fuel supply system can become acoustically "soft", that is to say that pressure fluctuations in the combustion chamber can affect the flow of the fuel, and that mutually escalating coupling can take place. Upon switching over, that can lead to pressure fluctuations of large amplitude, and thus to loud acoustic oscillations. This happens, very particularly, when injectors are virtually closed or have a leak. Without measures for acoustic hardening of the fuel supply system, however, it can also by all means occur that the instabilities are virtually critical in the entire switchover range. If the frequencies of the instabilities also further coincide with natural modes of combustion chambers, these acoustic fluctuations can thereby become a serious problem.

Possibilities for acoustic hardening of a fuel supply system are firstly to be rationalized and explained on the basis of some theoretical considerations, the next step being to outline the technical exemplary embodiments with the aid of the burners EV17i and EV18 of the applicant.

Figure 1:
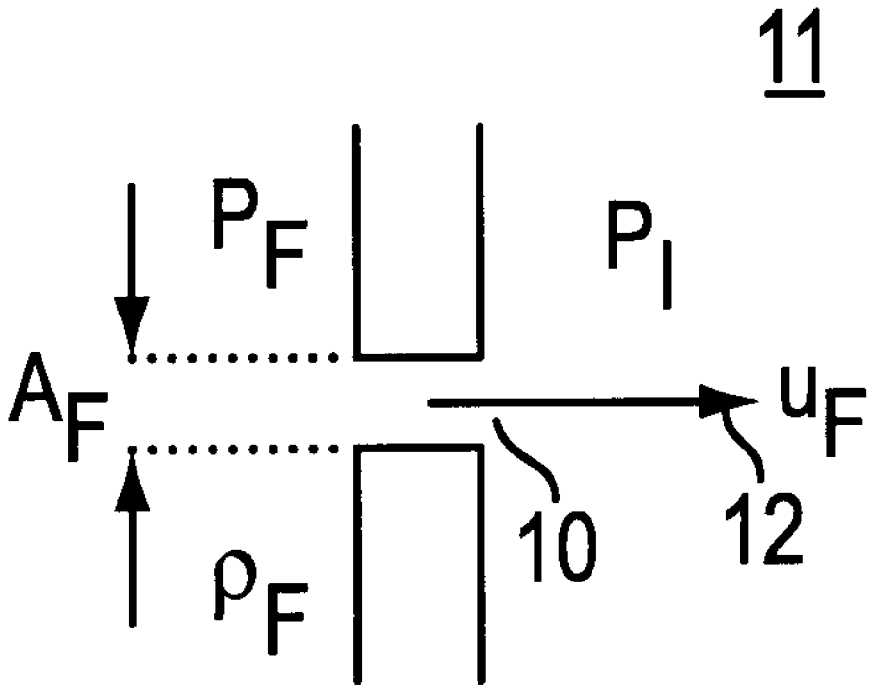
FIG. 1 shows a diagrammatic representation of a restrictor for the purpose of introducing the terminology used below.

Referring now to the drawings, wherein like reference numerals designate identical or corresponding parts throughout the several views, in the simplest case from an acoustic point of view the fuel supply system as represented in FIG. 1 can be regarded as a restrictor, that is to say as an opening 10 of negligible length and cross-sectional area $A_F$ through which fuel of density $\rho_F$ flows from a large volume at pressure $p_F$ into another large volume, the pressure chamber 11, at pressure $p_I$. It is assumed here that: $p_I > p_I$. It is also assumed that the fuel supply volume has a constant pressure $p_F$, while the pressure in the injection chamber $p_I$ can be subjected to fluctuations. The following relationship between fluctuations in the pressure in the injection chamber, $\Delta p_I$, and fluctuations in the fuel injection rate $\Delta u_F$ results under these conditions from the laws of hydrodynamics:

$$\Delta p_I = -\rho_F u_F \Delta u_F.$$

The pressure fluctuations in the injection chamber therefore act in a directly linear way on fluctuations in the fuel injection rate 12, and vice versa, that is to say there is a direct coupling of the two variables. In fact, the fuel supply systems of the gas turbines of the types GT24 and GT26 of the applicant behave in accordance with the above equation in a range of the natural modes of the combustion chambers, that is to say around oscillation frequencies of 100 Hz. The result is that instabilities are set up in the system comprising the fuel supply system, burner and combustion chamber as soon as the fuel injection rate 12 drops below a value of approximately 125 m/s.

More complicated fuel supply systems can be described by the following formula:

$$a(\omega)\Delta p_I = -\rho_F u_F \Delta u_F,$$

$\omega$ being the angular frequency of the periodic pressure oscillations, and $a=a(\omega)$ being a complex-value function of the angular frequency for whose modulus it holds that: $|a(\omega)| \leqq 1$. Consequently, by comparison with simple injection systems it is possible here for the critical fuel injection rate $u_{FC}$ to be reduced at least to the value $|a(\omega)|u_{FC}$. A possibility of achieving arbitrarily small values for a for any oscillation frequency is, for example, the use of non-return valves with a second opening, arranged upstream, of variable cross-sectional area. In this case, the pressure drop over the fuel supply system can be kept minimal even for very low fuel injection rates.

Figure 2A:
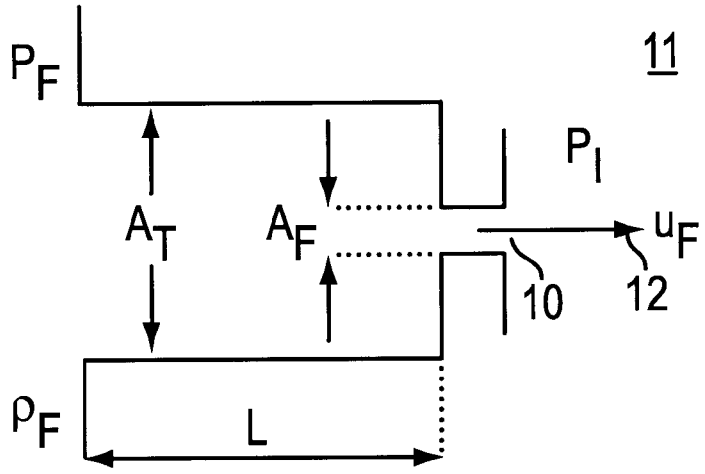
FIG. 2 shows in a) a diagram of a restrictor with an upstream constriction, and in b) a diagram of a restrictor with an upstream volume.

It may be shown that a fuel nozzle of cross-sectional area $A_F$ with a fuel supply line, arranged upstream, of length L and cross-sectional area $A_T$, as represented diagrammatically in FIG. 2*a*) leads to acoustic coupling of the form $$\Delta u_F = \frac{-\Delta p_1}{\rho_F u_F \left\{1 + \frac{A_F c_F^2}{A_T u_F} i \tan(\omega L / c_F)\right\}}$$

$C_F$ representing the speed of sound in the fuel gas. The complex-valued response function $a(\omega)$ is therefore given by $$a(\omega) = \frac{1}{\left\{1 + \frac{A_F c_F^2}{A_T u_F} i \tan(\omega L / c_F)\right\}}$$

and it is easy to see that such a line leads to perfect acoustic hardening of the fuel supply system, but this is so only in the range of the discrete frequency values $$\omega = (2N+1)\frac{\pi c_F}{2L},$$

for integral values of N.

Acoustic hardening in an entire frequency range can, however, be achieved only if the quotient $$\frac{A_F c_F}{A_T u_F}$$

is less than or equal to 1 in terms of order of magnitude. Consequently, in view of the fact that the Mach number $M=u_F/C_F$ is typically in the range from 0.25 to 0.3 for critical fuel injection, the cross-sectional area $A_F$ of the fuel line should be no more than 3 to 4 times as large as the cross-sectional area $A_F$ of the fuel nozzle. In other words, the fuel flow rate in the line should amount to at least a quarter to a third of the fuel injection rate $u_{FC}$ in the fuel nozzle 10. Unfortunately, however, in practice this requirement mostly cannot be realized without severe disadvantages.

Moreover, it must be borne in mind that each volume between the fuel line 15 and the fuel nozzle 10 must be small by comparison with a critical volume $V_{CRIT}$ which is given by:

$$V_{CRIT} = \frac{A_F c_F^2}{\omega u_F}.$$

Figure 3A:
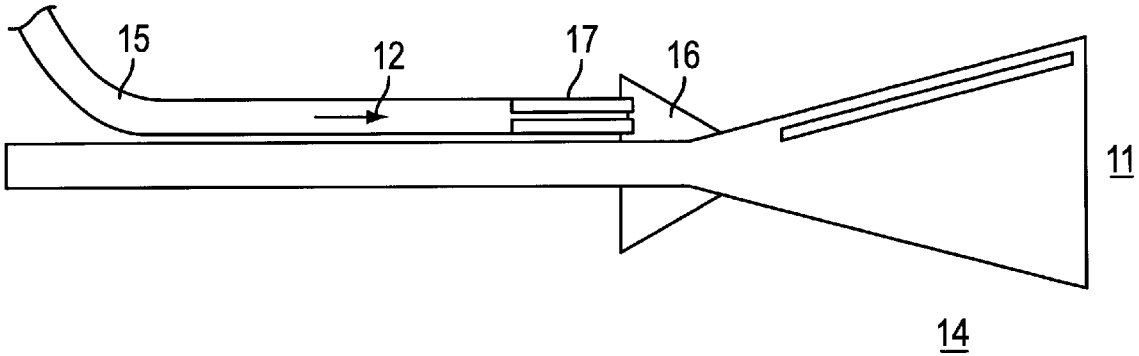
FIGS. 3*a, b* show diagrammatic representations of a burner of the type EV17i of the applicant, with acoustic damping means in the fuel supply system.

Normally, none of these conditions is fulfilled, as the following example is intended to substantiate: in FIG. 3*a*, a burner of the type EV17i of the applicant is represented diagrammatically in the way it is installed in, for example, a gas turbine of the type GT26 of the applicant. The fuel is fed to the burner 14 via a fuel supply line 15. In this case, the line 15 initially opens into an annular distribution chamber 16 starting from which fuel distribution channels run along the conical outer surface of the double cone burner. On the side facing the burner, these distribution channels have a multiplicity of fuel nozzles 10 through which the fuel can flow into the burner and thus into the combustion chamber 11. Assuming typical switchover conditions for such a burner, it may be seen that the volume between the fuel supply line 15 and the fuel nozzles 10, which is formed by the annular distribution chamber 16 and the distribution channels and is approximately 650 $CM^3$ exceeds the volume $V_{CRIT}$ of 271 $CM^3$ which is critical under these conditions by more than a factor of 2. Likewise, the diameter of the fuel supply line 15 is approximately 38 mm, although according to the above criterion it ought not to be more than 21 mm.

Figure 2B:
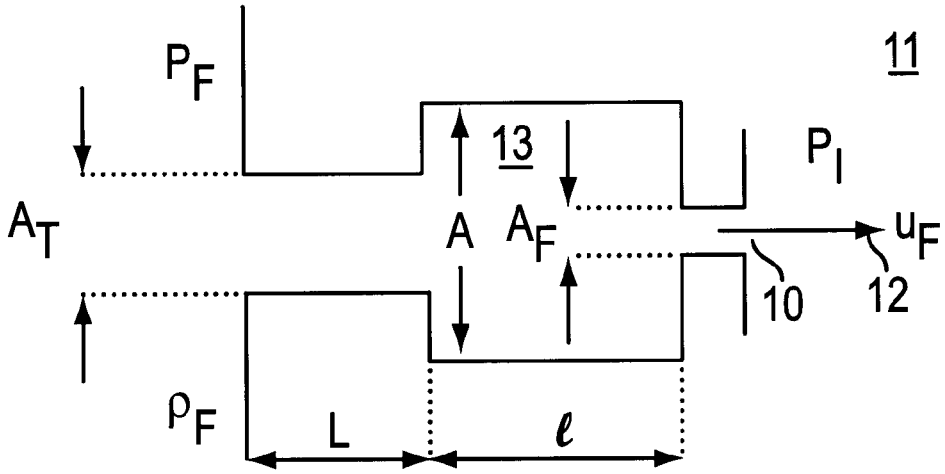

The introduction of a Helmholtz volume of appropriate cross-sectional area A and length L between the fuel supply line and the fuel nozzles 10, as represented diagrammatically in FIG. 2*b*), is a simple possibility, associated with a low design outlay, for the acoustic hardening of the prescribed design. It is of great advantage in this case to set the dimensions of the volume and the constriction in such a way that at least one resonance of the fuel supply system coincides with the most important fundamental acoustic natural frequency of the combustion chamber.

Assuming typical switchover conditions for an EV17i burner, as they are listed in Table 1 and occur in a gas turbine of the type GT26B, it is then possible to calculate the response function a(ω).

TABLE 1

| Variable | Unit | Value |
|---|---|---|
| Pressure | bar | 18 |
| Nozzle cross-sectional area | $m^2$ | 0.000111 |
| Temperature of methane | K | 323 |
| Mass flow of methane | kg/s | 0.167 |
| Length of the line | m | 2 |
| Diameter of the line | m | 0.038 |
| Length of the first volume | m | 0.1 |
| Cross-sectional area of the first volume | $m^2$ | 6.5e-3 |

Figure 4:
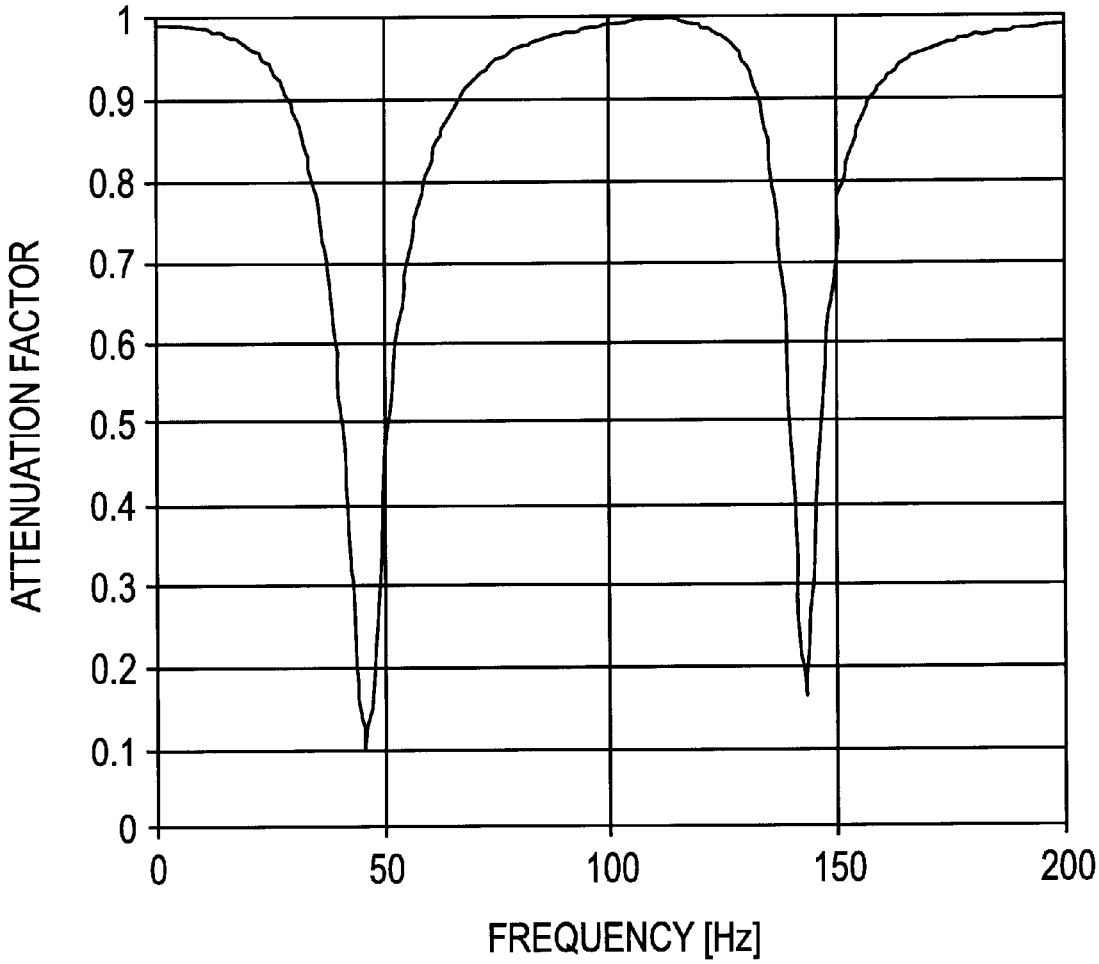
FIG. 4 shows the coupling behavior between pressure fluctuations and fuel flow fluctuations for a burner of the type EV17i of the applicant without acoustic damping means in the fuel supply system.

The attenuation factor a(ω) is represented in FIG. 4 as a function of the frequency of the pressure fluctuations considered for the conditions listed in Table 1. A value of a(ω)=1 as upper limit corresponds in this case to a normal restrictor according to the diagrammatic representation in FIG. 1, and thus a maximum coupling of the pressure fluctuations in the combustion chamber 11 to the fuel flow; a value of a(ω)=0 means that a pressure fluctuation $\Delta p_I$ in the combustion chamber 11 is not capable of effecting a change in the fuel injection rate, $\Delta u_F$. It may be seen from FIG. 4 that the attenuation occurs only in narrow ranges about the resonant frequencies of the fuel supply system. It is also clearly visible from FIG. 4 that in the range of the natural modes of the combustion chamber considered, in particular, that is to say at approximately 90 Hz, the fuel supply system behaves like a simple and virtually completely undamped restrictor, and thus the resonance behavior of the fuel supply system is not tuned at all to that of the combustion chamber.

Figure 3B:
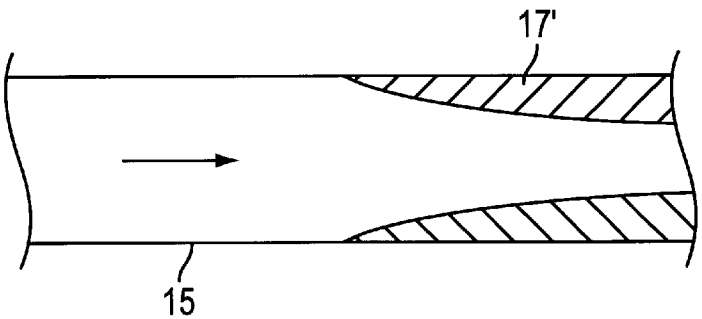

If, as likewise represented in FIG. 3*a*, a line constriction (17) is introduced into the fuel supply line 15, the resonant frequency of the fuel supply system is displaced and widened in the range of 90 to 100 Hz, and a minimum value of a to approximately 0.35–0.4 in the case of this frequency. This is so for simple use of an insert 17 (or a constriction effected in some other way in the line, such as a tapered line section 17' between the fuel supply line 5 and the first volume, see FIG. 3*b*) of 300 mm length and an inside diameter of 21 mm. A further improvement can be achieved with the values given in Table 2 by increasing the length of the insert 17 from 300 mm to 500 mm, and additionally reducing the first volume from 650 CM3 to 400 CM3.

TABLE 2

| Variable | Unit | Value |
|---|---|---|
| Pressure | bar | 18 |
| Nozzle cross-sectional area | $m^2$ | 0.000111 |
| Temperature of methane | K | 323 |
| Mass flow of methane | kg/s | 0.167 |
| Length of the line | m | 0.5 |
| Diameter of the line | m | 0.021 |
| Length of the first volume | m | 0.1 |
| Cross-sectional area of the first volume | $m^2$ | 4.0e-3 |

Figure 5:
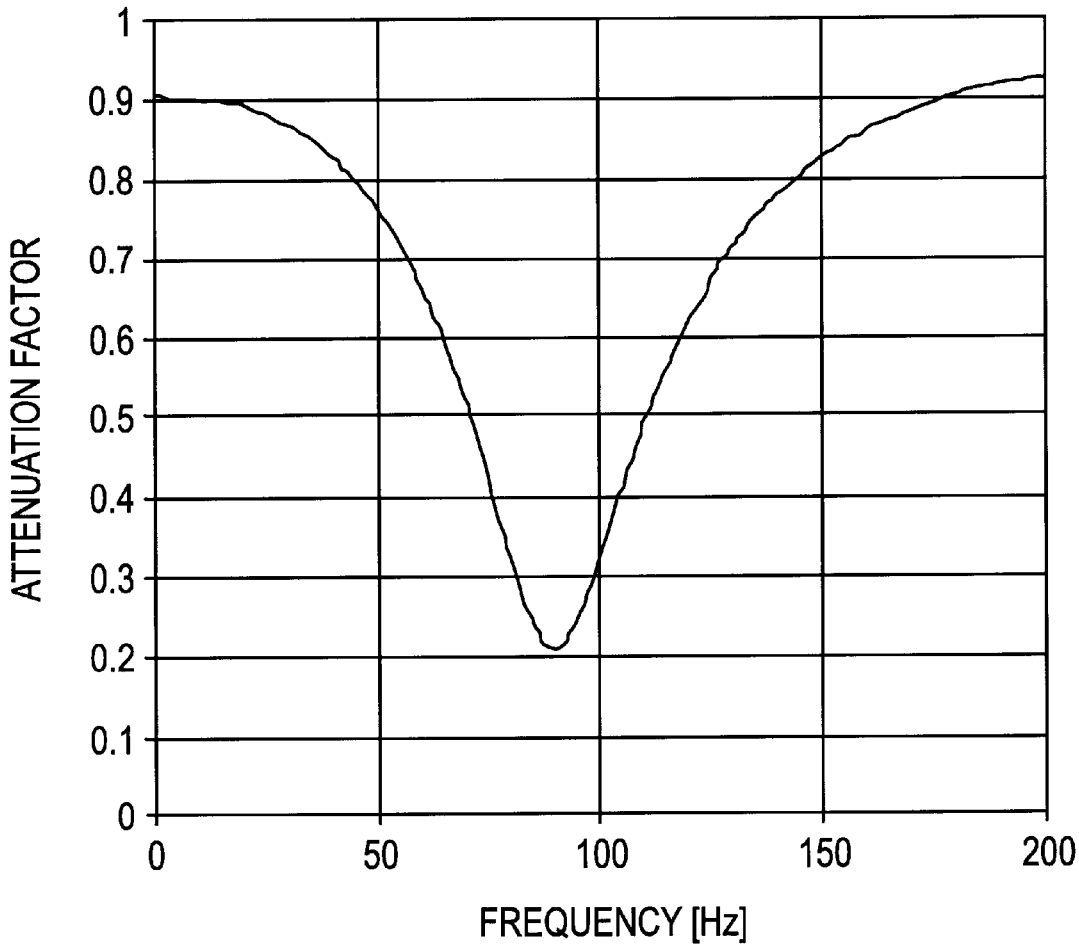
FIGS. 5 and 6 show the coupling behavior between pressure fluctuations and fuel flow fluctuations for a burner of the type EV17i of the applicant, with different acoustic damping means in the fuel supply system.

The absorption profile for the values from Table 2 is represented in FIG. 5. Essentially, these further measures change the minimum value of a to a value of 0.2 in the case of the frequency from 90 to 100 Hz, and this corresponds to a doubling of the absorption efficiency by comparison with the first example.

A further improvement can be achieved with the values from Table 3, specifically by doubling the length of the constriction 17 again and once more halving the volume.

TABLE 3

| Variable | Unit | Value |
|---|---|---|
| Pressure | bar | 18 |
| Nozzle cross-sectional area | $m^2$ | 0.000111 |
| Temperature of methane | K | 323 |
| Mass flow of methane | kg/s | 0.167 |
| Length of the line | m | 1 |
| Diameter of the line | m | 0.021 |
| Length of the first volume | m | 0.05 |
| Cross-sectional area of the first volume | $m^2$ | 2.0e-3 |

Figure 6:
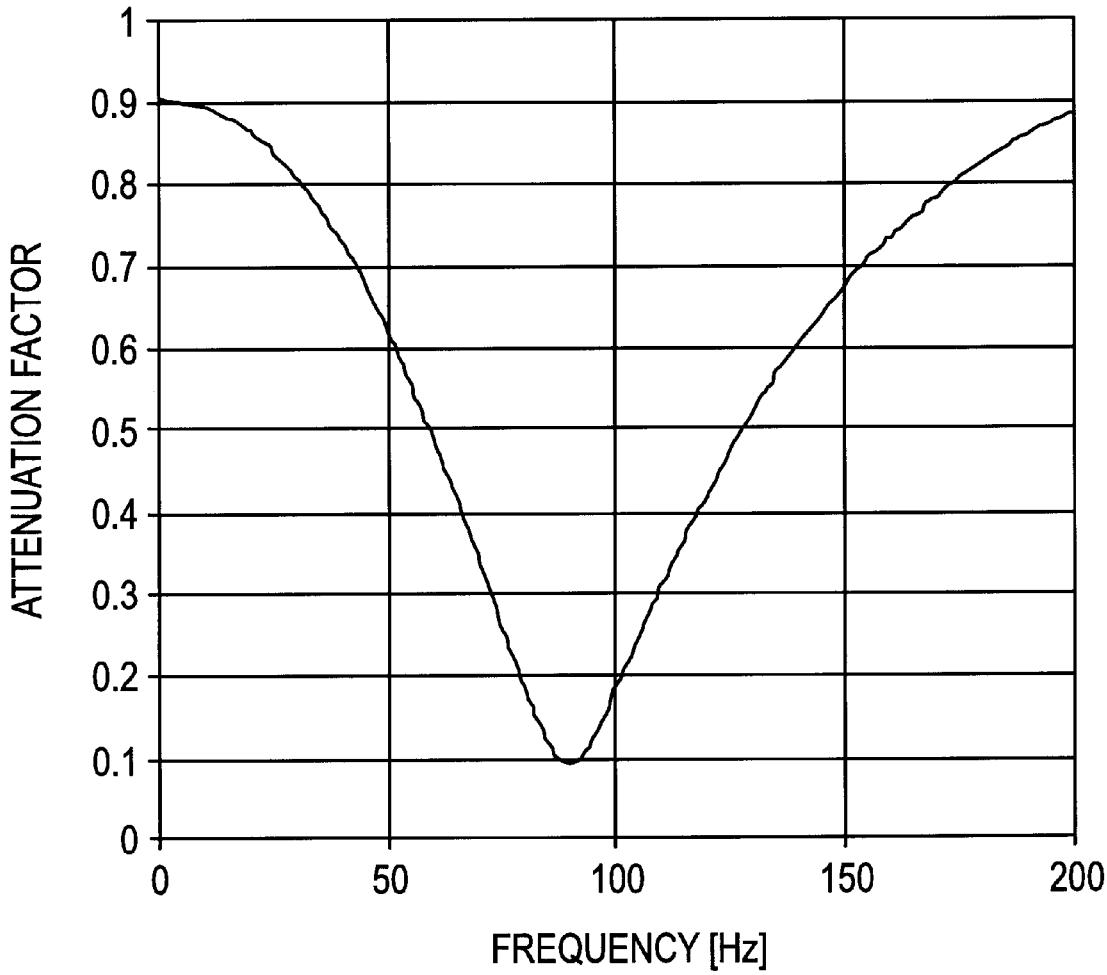

The resulting absorption profile is represented in FIG. 6; in the resonance range from 90 to 100 Hz, it has an absorption of a remarkable 90% by comparison with the simple restrictor.

Figure 7:
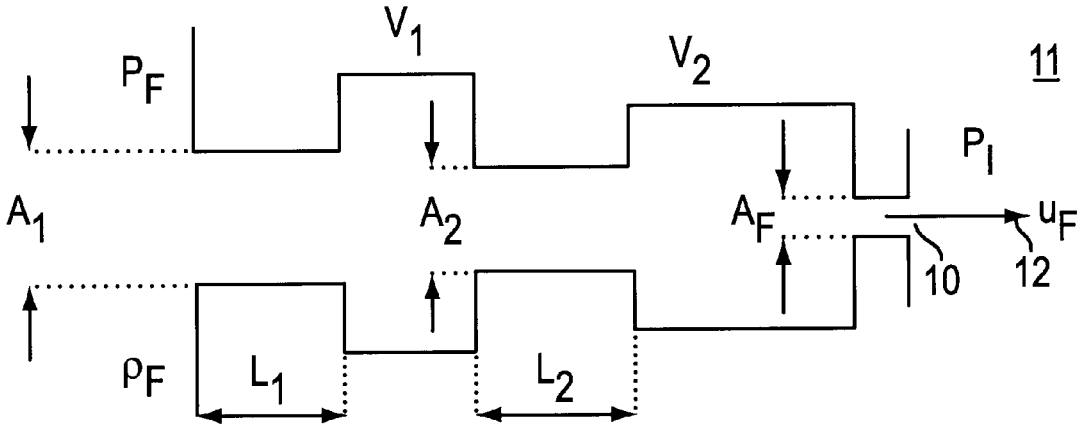
FIG. 7 shows a diagram of a restrictor with two upstream volumes.
Figure 8:
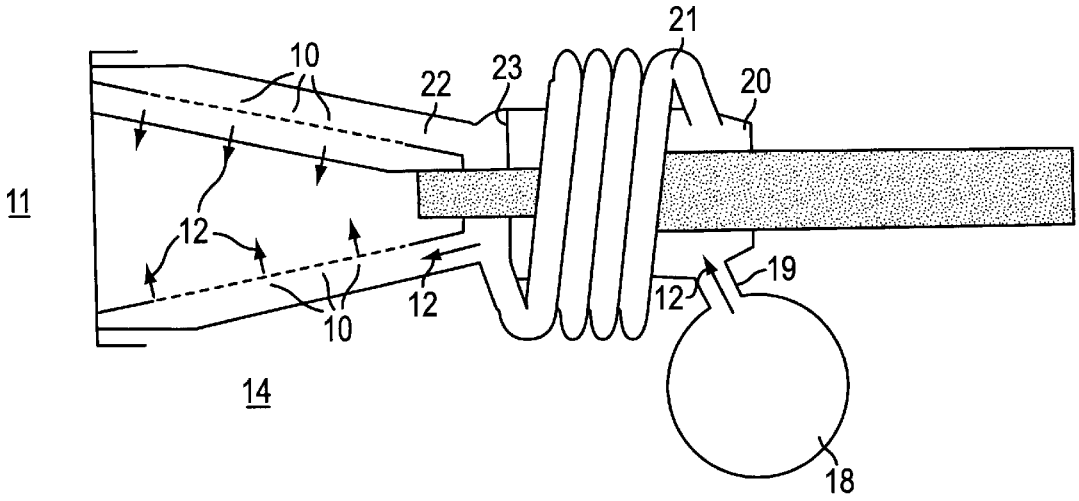
FIG. 8 shows a diagram of a burner of the type EV18 of the applicant, as is installed in a turbine of the type GT26 of the applicant, with acoustic damping means in the fuel supply system.

The acoustic hardening of a burner of the type EV18 of the applicant, such as is installed in a gas turbine of the type GT26, may serve as a further exemplary embodiment. As already represented with acoustic hardening in FIG. 8, in such a gas turbine the fuel is fed to the burner 14 via annular fuel distribution lines 18 which jointly supply burners arranged annularly in the annular combustion chamber of the turbine. Via a second constriction 19, the fuel branches off from the annular fuel distribution line 18 and enters a volume which is normally formed by the volumes 20 and 22, without the partition 23 specified in FIG. 8, and the first constriction 21. The fuel is guided through the fuel distribution channels 22 along the cone of the burner 14, and enters the combustion chamber 11, where it is mixed with combustion air, through the fuel nozzles 10. Here, it is now necessary for practical reasons to find a solution to the acoustic hardening in which the fuel distribution system has to be changed as little as possible. This is performed most simply by the arrangement of two volumes connected upstream of the fuel nozzle 10 and connected to the fuel supply line via two constrictions, as represented diagrammatically in FIG. 7. A possible technical realization is represented in FIG. 8. A partition 23 divides the large volume into the fuel distribution channels 22 and a second volume 20, and a constriction 21 which is wound around the burner and constructed as a line connects the two volumes. If the first constriction 21 is selected as a line of 1.2 m length and 20 mm inside diameter, and typical switchover conditions in such a gas turbine as is represented in Table 4 are selected, the result is the absorption characteristic in FIG. 9.

TABLE 4

| Variable | Unit | Value |
|---|---|---|
| Pressure | bar | 18 |
| Nozzle cross-sectional area | $m^2$ | 9.08e-5 |
| Temperature of methane | K | 323 |
| Mass flow of methane | kg/s | 0.133 |
| Length of the second constriction | m | 0.04 |
| Cross-sectional area of the second constriction | $m^2$ | 0.000314 |
| Second volume | $m^2$ | 0.0015 |
| Length of the first constriction | m | 1.2 |
| Cross-sectional area of the first constriction | $m^2$ | 0.000314 |
| First volume | $m^3$ | 0.00015 |

Figure 9:
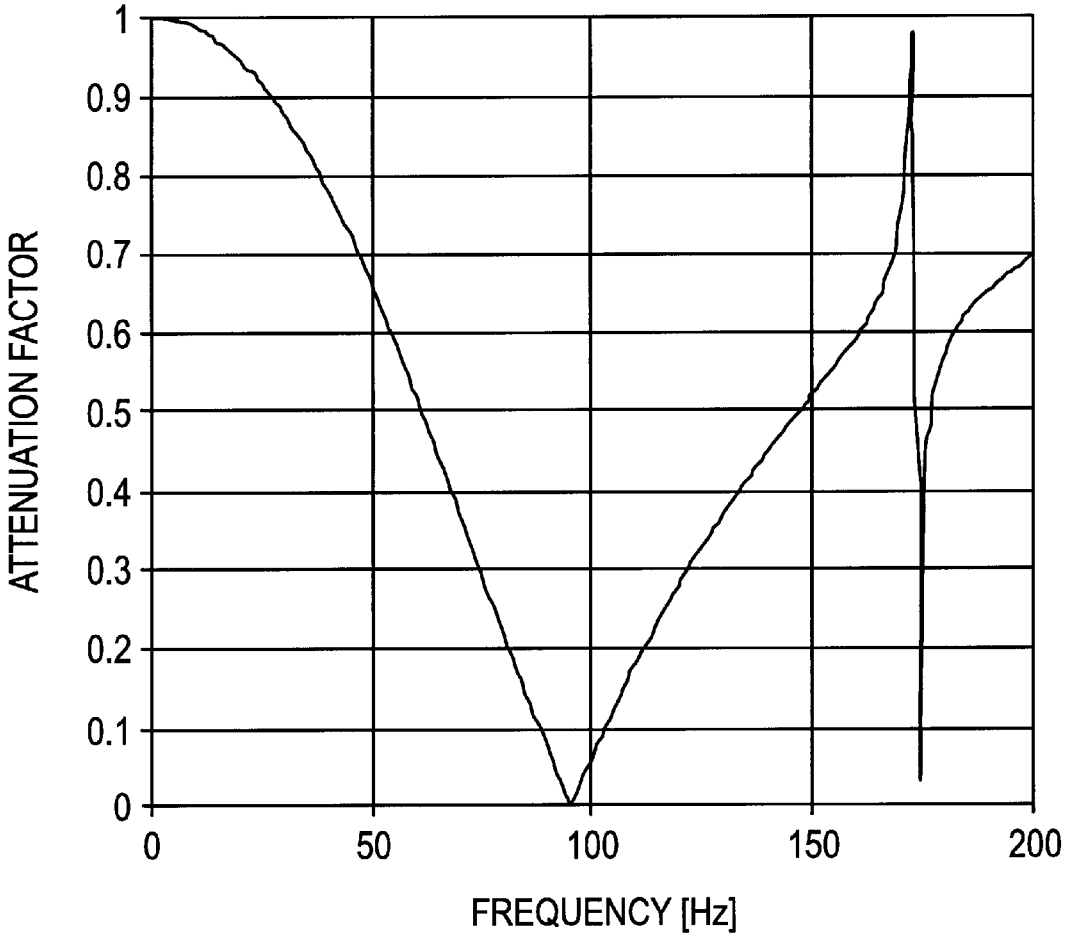
FIG. 9 shows the coupling behavior between pressure fluctuations and fuel flow fluctuations for a burner of the type EV18 of the applicant, as it is installed in a turbine of the type GT26 of the applicant, with acoustic damping means in the fuel supply system.

As may be seen from FIG. 9, with this arrangement and dimensioning of two volumes connected one behind another perfect damping of the acoustic coupling is achieved in the case of a natural frequency of the combustion chamber of approximately 90 Hz with a considerable width of the resonance condition; specifically, ⅔ are still absorbed in the case of an approximately ±30 Hz deviation from the resonance condition.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United Sates is:

1. A burner comprising:

a burner body having a combustion chamber;

a fuel nozzle positioned to inject fuel into the burner body;

at least one fuel supply system through which the burner can be fed a fuel flow through the fuel nozzle and subsequently burned in the combustion chamber;

means for preventing acoustic pressure oscillation in the combustion chamber from leading to fluctuations in the fuel flow in the fuel supply system;

wherein the means for preventing comprises at least a first volume arranged directly upstream of the fuel nozzle, through which first volume the fuel flow can flow, and a first constriction upstream of the first volume, the fuel supply system being arranged upstream of the first constriction;

wherein the first volume comprises an annular distribution chamber and distribution channels which are arranged downstream of the annular distribution chamber and run at least partially outside the burner so that the fuel can flow from the distribution channels through the fuel nozzle into the combustion chamber.

2. The burner as claimed in claim 1, wherein the acoustic oscillations are in a range of acoustic natural oscillations of the combustion chamber.

3. The burner as claimed in claim 1, further comprising fuel flowing in the fuel supply system, wherein the fluctuations in the fuel flow in the fuel supply system are periodic, and the frequency of these periodic fluctuations in the fuel flow is in a range of acoustic natural oscillations of the combustion chamber.

4. The burner as claimed in claim 1, further comprising fuel flowing through the first volume;

wherein the first volume is smaller than a critical volume $V_{crit}$ and wherein $$V_{crit} \approx (A_f c^2)/(\omega \cdot U_f),$$

wherein $A_F$ is the cross-sectional area of the opening of the fuel nozzle;

$C_F$ is the square of the speed of sound in the first volume;

$\omega$ is the angular frequency of the acoustic oscillation; and $U_F$ is the flow rate of the fuel flow.

5. The burner as claimed in claim 1, further comprising fuel flowing through the fuel nozzle, wherein the first constriction has a cross-sectional area $A_T$, wherein $$A_T \leqq A_F \cdot (C_F/U_F);$$

and wherein $A_F$ is the cross-sectional area of the fuel nozzle;

$C_F$ is the velocity of sound in the fuel; and $U_F$ is the velocity of the fuel.

6. The burner as claimed in claim 1, wherein the dimensions of the first volume and first constriction are selected so that a resonance frequency of the absorption of the fuel supply system is in the range of the natural modes of the combustion chamber.

7. The burner as claimed in claim 1, further comprising a fuel supply line upstream of the first volume, and wherein the first constriction comprises a tubular insert in the fuel supply line.

8. The burner as claimed in claim 1, further comprising a second constriction and a second volume both arranged upstream of the first constriction through which the fuel can flow, the second volume is connected upstream via the second constriction to the fuel supply system, the fuel supply system arranged upstream of the second constriction.

9. The burner as claimed in claim 8, wherein the dimensions of the first volume, the second volume, the first constriction, and the second constriction are selected such that a resonance frequency of the absorption of the fuel supply system is in the range of natural modes of the combustion chamber.

10. The burner as claimed in claim 8, wherein the first constriction comprises a line of small cross section which connects the first volume to the second volume, and comprising a partition which separates the second volume from the first volume.

11. The burner as claimed in claim 1, further comprising a fuel supply line upstream of the first volume, and wherein the first constriction comprises a tapered line section between the fuel supply line and the first volume.

* * * * *